US007175243B2

(12) United States Patent
Mittag et al.

(10) Patent No.: US 7,175,243 B2
(45) Date of Patent: Feb. 13, 2007

(54) FRAMELESS CABINET DOOR SYSTEM AND METHOD

(75) Inventors: Douglas C. Mittag, Bolingbrook, IL (US); Gary Anderson, Sandwich, IL (US)

(73) Assignee: Richards-Wilcox, Inc., Aurora, IL (US)

( * ) Notice: Subject to any disclaimer, the term of this patent is extended or adjusted under 35 U.S.C. 154(b) by 0 days.

(21) Appl. No.: 11/431,210

(22) Filed: May 10, 2006

(65) Prior Publication Data

US 2006/0238088 A1 Oct. 26, 2006

Related U.S. Application Data

(62) Division of application No. 10/714,776, filed on Nov. 17, 2003.

(51) Int. Cl.
*A47B 49/00* (2006.01)

(52) U.S. Cl. ..... 312/326

(58) Field of Classification Search ..... 312/324, 312/329, 352, 257.1, 326
See application file for complete search history.

(56) References Cited

U.S. PATENT DOCUMENTS

| | | | |
|---|---|---|---|
| 2,591,172 | A | 4/1952 | Lundine |
| 2,634,184 | A | 4/1953 | Carlson |
| 3,006,709 | A | 10/1961 | Krey |
| 3,166,367 | A | 1/1965 | Vincens |
| 4,289,363 | A | 9/1981 | Andersson et al. |
| 4,836,626 | A | 6/1989 | Taylor et al. |
| 5,265,954 | A | 11/1993 | Keil |
| 5,464,281 | A | 11/1995 | Maro |
| 5,570,940 | A | 11/1996 | Maro |
| 6,105,513 | A | 8/2000 | Mittag |
| 6,789,859 | B1 | 9/2004 | Ho |
| 2001/0016787 | A1 | 8/2001 | Sanders et al. |

OTHER PUBLICATIONS

Quik-Lok Shelving Assembly Instructions No. 3502-A.
Aurora Shelving Assembly Instructions No. 3501-A.
Aurora Shelving Planning Guide Brochure.
Two Sheets of pictures of cabinet.

*Primary Examiner*—Peter M. Cuomo
*Assistant Examiner*—Noah Chandler Hawk
(74) *Attorney, Agent, or Firm*—Schiff Hardin LLP

(57) ABSTRACT

In accordance with the invention, a method and system is provided by which door panels are installed on the cabinet. A bottom support and a top support are installed to corner posts in the cabinet. A bottom door jamb is installed on the bottom support. Pivot pins are provided at a top and bottom of each of the right and left door panels. With the door panels upright, the respective bottom pivot pins are inserted in respective apertures of the bottom door jamb. An upper door jamb is positioned such that apertures of the upper door jamb are received over the respective top pivot pins of the right and left door panels. The upper door jamb is then attached to the top support.

21 Claims, 7 Drawing Sheets

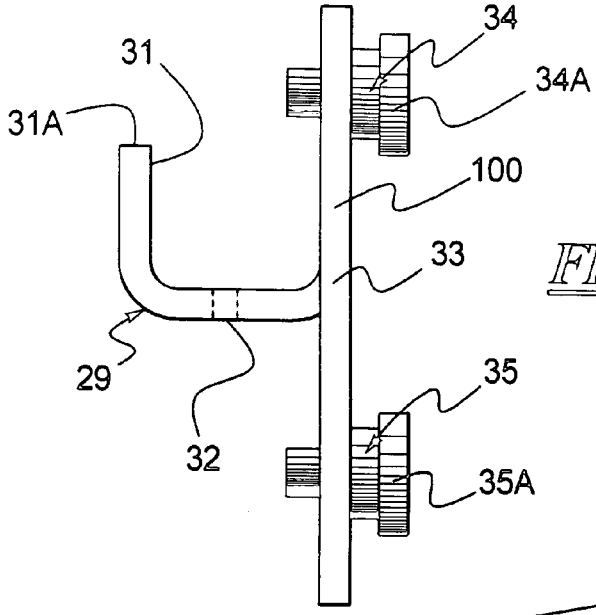
FIG. 4A
FIG. 4B
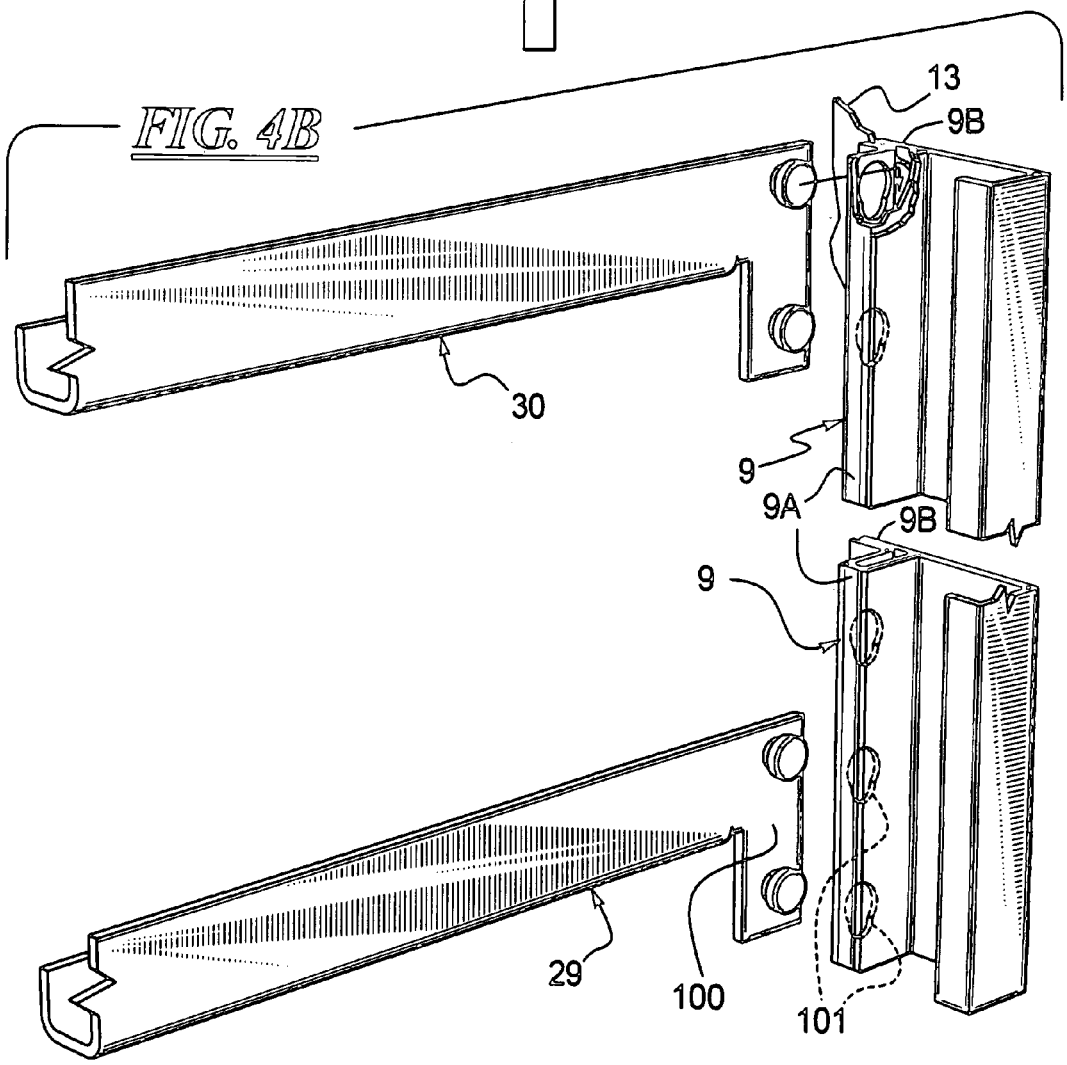

FRAMELESS CABINET DOOR SYSTEM AND METHOD

RELATED APPLICATION

The present application is a divisional of parent application Ser. No. 10/714,776 titled "Frameless Cabinet Door System and Method", filed Nov. 17, 2003.

BACKGROUND OF THE INVENTION

It is known to provide a steel shelving unit having a plurality of adjustable shelves, such as shown in U.S. Pat. No. 6,105,513. It is also known to provide a cabinet with steel shelving having a back panel, two side panels, and two door panels mounted on a rigid welded frame. The frame, with the door panels attached to the frame, may be used to retrofit to an existing steel cabinet by mounting the frame with the doors onto the front of the cabinet. With such a prior art system, however, the frame with the attached door panels is shipped to a customer as a large bulky unit. Furthermore, hinges are visible at sides of the frame where the door panels are attached to the frame. Also, the frame must be accurately aligned and welded, and a substantial number of components are required for manufacturing the frame with the attached door panels.

When welding the frame, there is the disadvantage that it is difficult to keep the frame square and true during manufacture.

SUMMARY OF THE INVENTION

It is an object of the invention to simplify a door system installed on a cabinet, to reduce manufacturing cost and complexity thereof, and to minimize the number of components employed.

In accordance with the invention, a method and system is provided by which door panels are installed on the cabinet. A bottom support and a top support are installed to corner posts in the cabinet. A bottom door jamb is installed on the bottom support. Pivot pins are provided at a top and bottom of each of the right and left door panels. With the door panels upright, the respective bottom pivot pins are inserted in respective apertures of the bottom door jamb. An upper door jamb is positioned such that apertures of the upper door jamb are received over the respective top pivot pins of the right and left door panels. The upper door jamb is then attached to the top support.

BRIEF DESCRIPTION OF THE DRAWINGS

FIG. 4A is an end view of top and bottom shelf supports;

FIG. 4B is a front fragmentary perspective view of the top and bottom shelf supports prior to attachment;

DESCRIPTION OF THE PREFERRED EMBODIMENT

Figure 1:
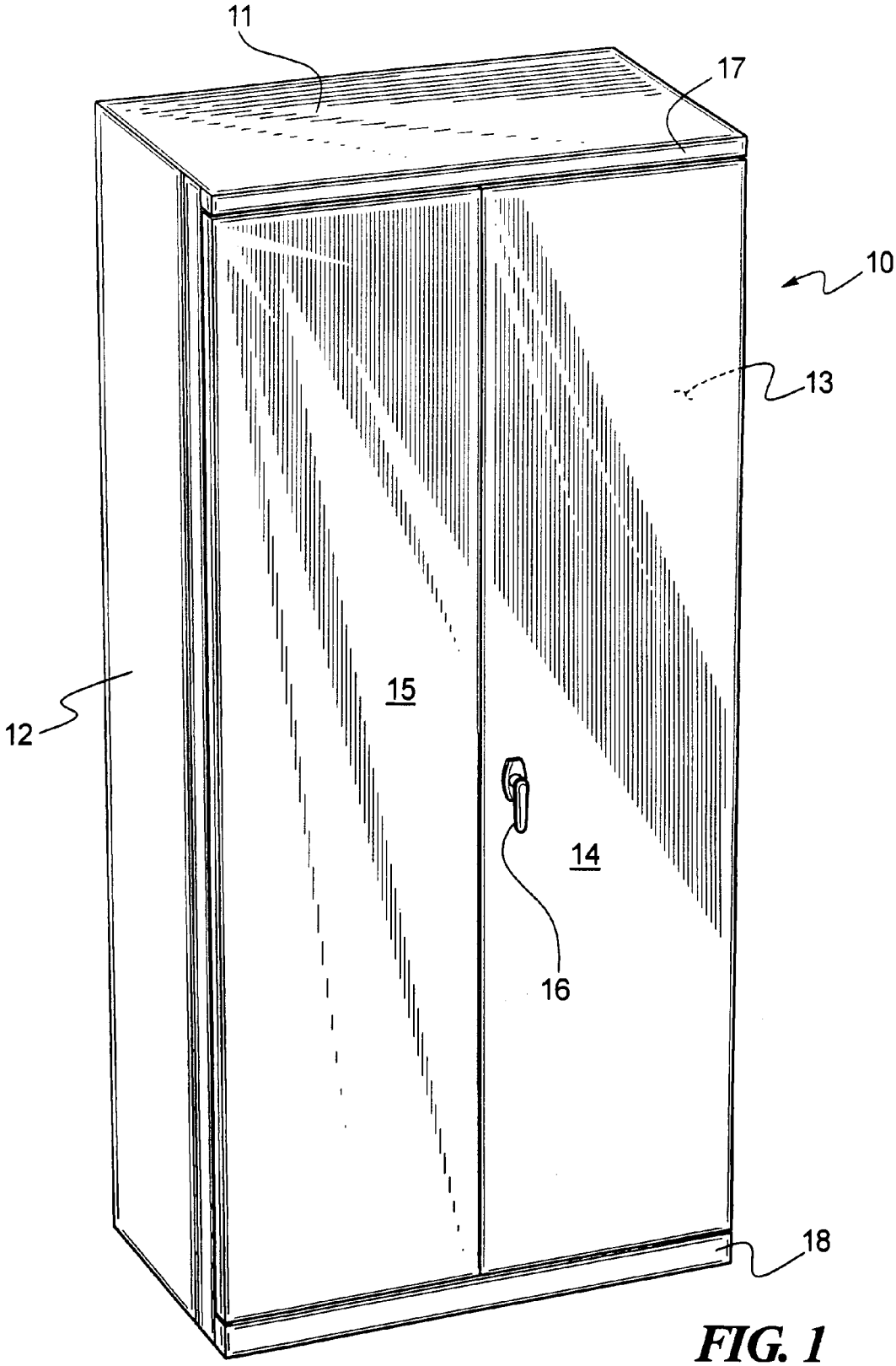
FIG. 1 is a perspective front view of a frameless cabinet door system with the door panels closed.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Figure 2:
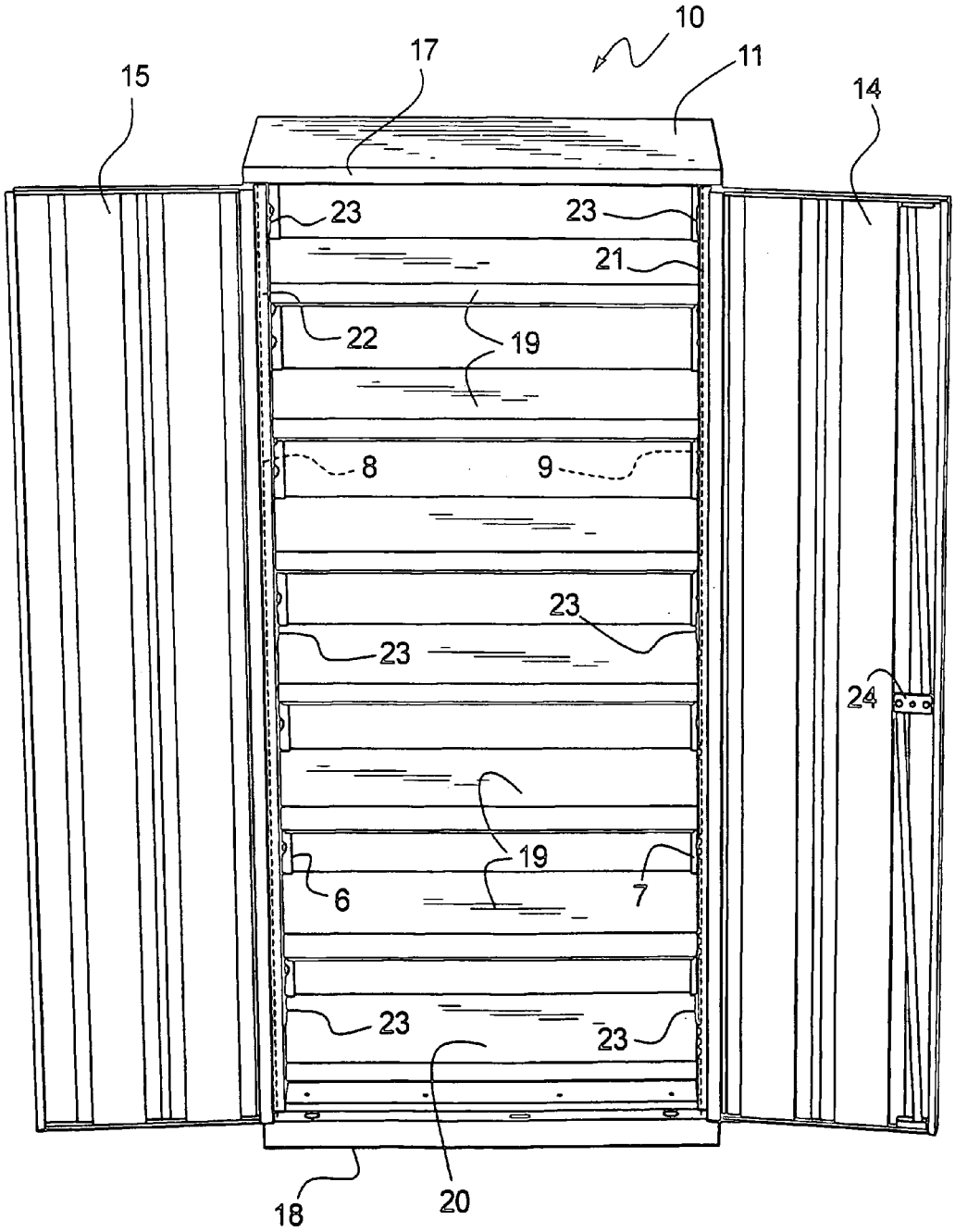
FIG. 2 is a front perspective view of the cabinet door system of FIG. 1, but with the door panels open.

The storage cabinet 10 having the frameless cabinet door system is shown in front perspective in FIG. 1 with the doors closed. As shown in FIG. 2 with the doors open, the cabinet has four L-shaped cross-section corner posts 6, 7, 8, and 9 supporting shelves, a top panel 11, a left side panel 12, and a right side panel 13. The back and front corner posts are L-shaped and folded to create a double-walled first and second flanges such as 9A, 9B with the first flange 9A double-walled construction having a greater gap since one of the walls has slots therein for receiving pins with locking buttons as described hereafter. A right door panel 14 and a left door panel 15 are shown in the closed configuration. A lock handle 16 for opening and closing the door panels is provided.

A top door jamb 17 and a bottom door jamb 18 are positioned above and below the door panels. Significantly, no side hinges are visible, providing an overall advantageous "clean" look.

In FIG. 2, the right and left door panels 14 and 15 are swung open and the interior of the cabinet 10 is illustrated from the front. The cabinet 10 has a plurality of adjustable shelves 19, and a bottom shelf 20, supported by shelf supports not visible in FIG. 2.

If necessary, to provide clearance for files at the front of the cabinet, an optional right extender 21 and an optional left extender 22 are provided, as described in more detail hereafter. These extenders are fastened to the front of the cabinet at respective corner posts 9, 8 by a plurality of extender clamps 23 described hereafter. Also, a lock assembly 24 is generally shown attached to the right hand door panel 14 and is activated by the lock handle 16 as shown in FIG. 1.

Figure 3B:
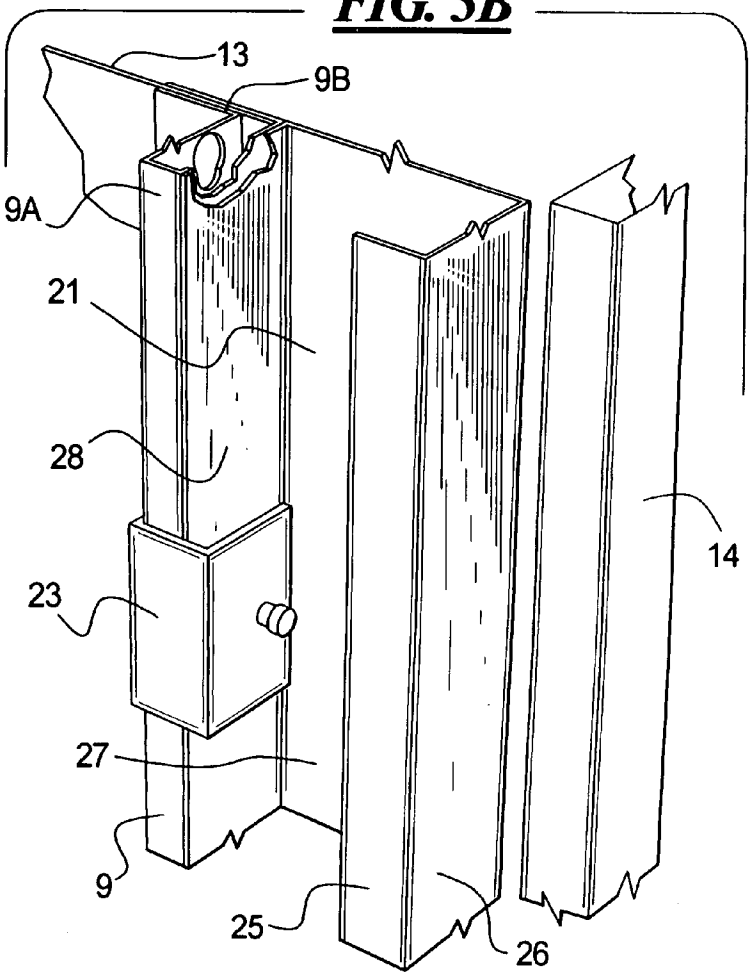
FIG. 3B is a fragmentary perspective view showing the extender mounted on the front of the cabinet by an extender clamp.
Figure 3A:
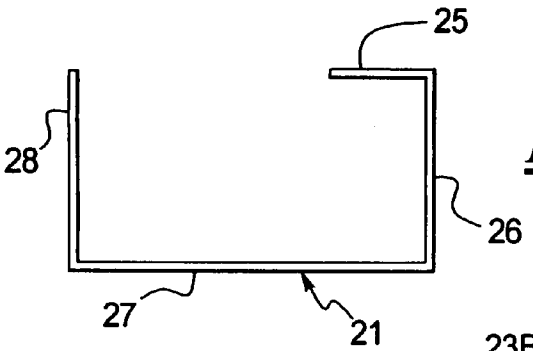
FIG. 3A is an end view of an extender which is optionally employed when mounting the door panels on the cabinet.

FIG. 3A shows an end view of the right side extender 21 having an inside lip 25, a front surface 26, an outer side surface 27, and a back clamping surface 28.

Figure 3C:
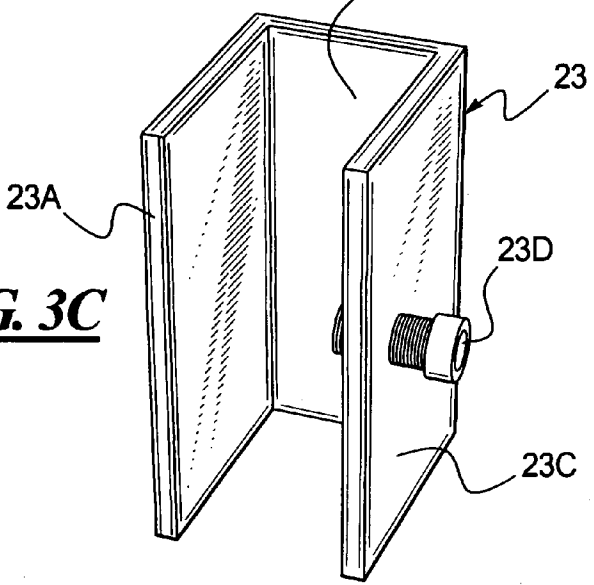
FIG. 3C is a perspective end view of the extender clamp used to mount the extender.

As shown in the perspective view of FIG. 3B, extender clamp 23 shown in perspective cross-section in FIG. 3C mounts the extender 21 to a flange 9A of L-shaped corner post 9 at the front of the cabinet. A similar extender 22 at the left side is mounted to corner post 8. The extender clamp has clamping side surfaces 23A, 23C and a junction surface 23B. The set screw 23D may also be provided to tighten the attachment of the extender to the cabinet corner post flanges 9A.

To support the top and bottom door jambs and also the bottom shelf, as shown in FIG. 4B identical bottom and top shelf supports 29 and 30 are provided. As shown in the end view of FIG. 4A, the shelf support 29 has a vertical section 31 with a top edge 31A, a horizontal intermediate surface 32, and a front surface 33 with first and second protruding locking pins having locking buttons 34A, 35A at each end of the shelf support mounted on a support tab 100 projecting from the outer ends of the shelf support.

The locking pins 34 and 35 with respective locking buttons 34A, 35A are received in locking apertures 101 extending vertically along a back wall of a double-wall second flange 9B of L-shaped corner flange 9. As shown in FIG. 4B, the L-shaped corner post 9 has a doubled wall first flange 9A and the doubled wall second flange 9B formed by the steel being folded back on itself. The flange 9A has a greater spacing between its doubled walls to allow for sufficient room for receiving the locking buttons 34A and 35A in the space between the doubled walls. The flange 9B has a smaller spacing and receives the edge of the cabinet side 13. The same type of shelf supports like supports 29 and 30, of course, may also be employed for supporting the intermediate shelves 19.

Figure 5C:
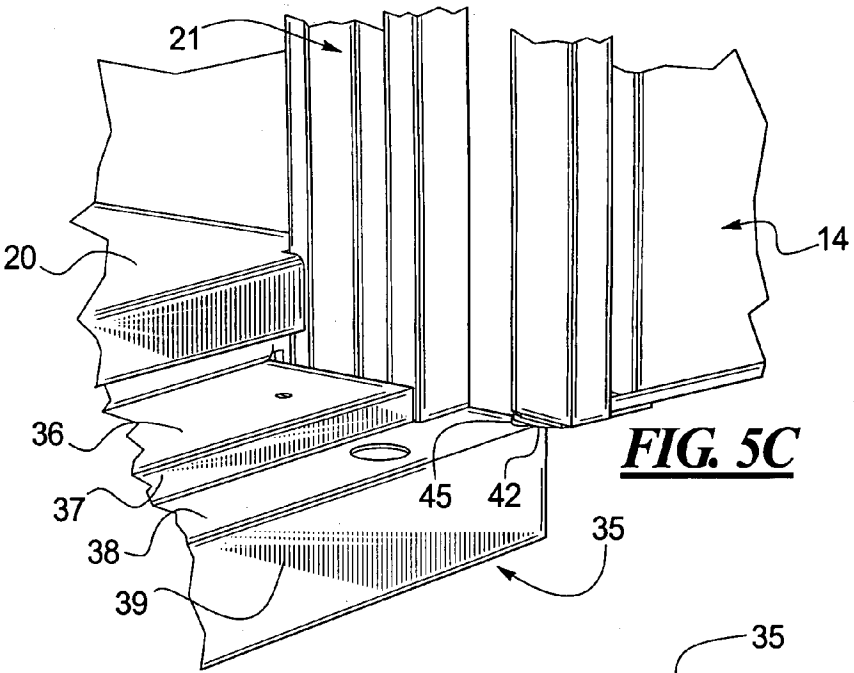
FIG. 5C is a fragmentary perspective view showing the bottom door jamb installed at the bottom of the cabinet and with the right side door panel attached.
Figure 5A:
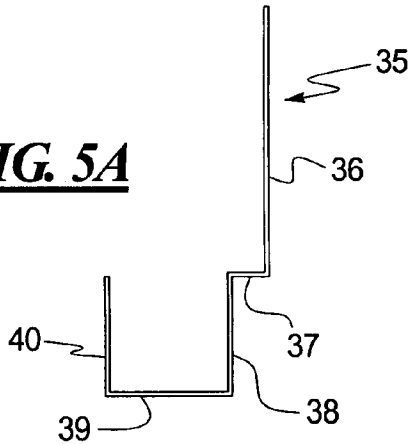
FIG. 5A is an end view of the bottom jamb for the door system.
Figure 5B:
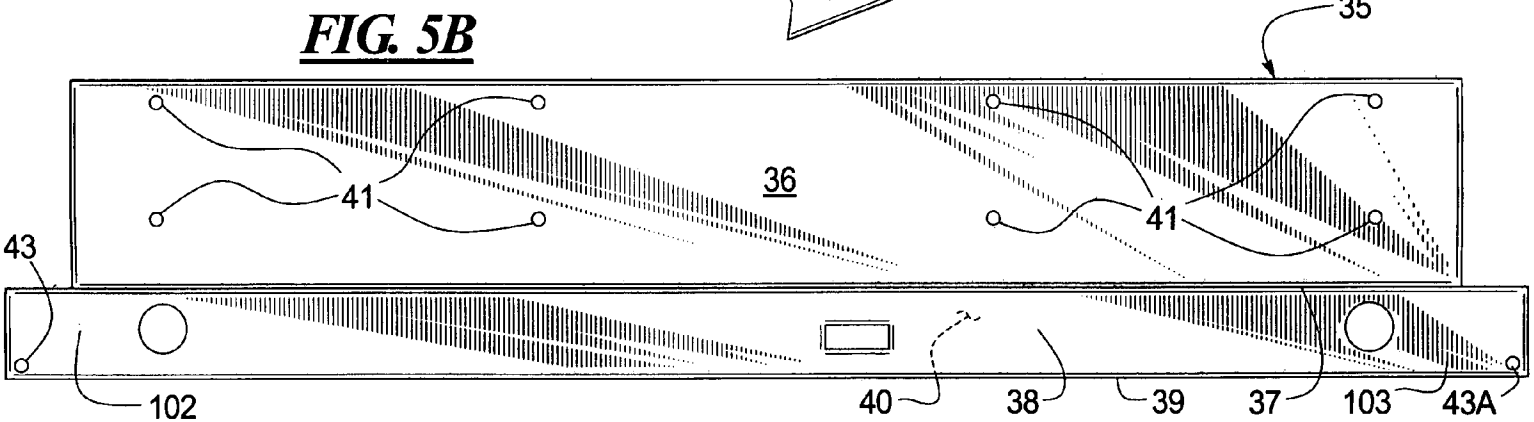
FIG. 5B is a plan view of the bottom door jamb.

The bottom door jamb 35 is shown in an end view and a plan view in respective FIGS. 5A and 5B. The bottom door jamb 35 has a stepped up horizontal raised surface 36 at the top of a step vertical wall 37. Below the raised surface 36 at the base of step wall 37 is a horizontal lower surface 38 terminating at the front of the jamb with an outwardly facing vertical jamb surface 39. A bottom base surface 40 is provided below the lower surface 38.

The raised surface 36 has a plurality of mounting holes 41. The lower surface 38 has door panel pivot holes 43 and 43A in outwardly extending ends 102 and 103 of lower surface 38.

As shown in the perspective view of FIG. 5C, the door 14 is mounted to the jamb 35 after the jamb 35 has been mounted in position just below the bottom shelf 20. A pivot plate 42 at the bottom of the door 14 has a pivot pin 44 carrying a slip over bushing 45 as a weight bearing surface (See also FIG. 6B). The pivot plate 42 is attached by screws 46, 47 at the bottom of the door as shown in FIG. 6B. A similar plate 56 having an associated pivot pin 200, but without any bushing, is provided at the top of the door 14 as shown in FIG. 7C.

Figure 6A:
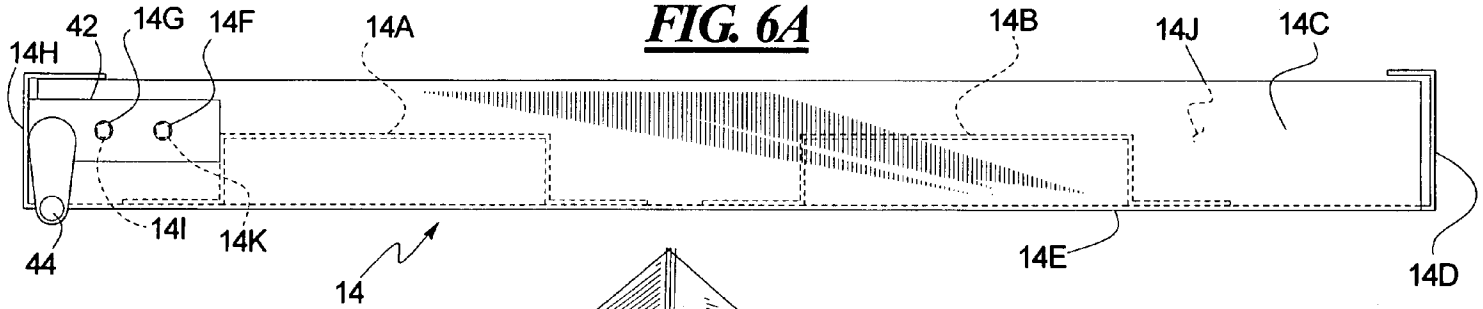
FIG. 6A is a bottom view of the right side door panel with a bottom pivot pin plate attached.
Figure 6B:
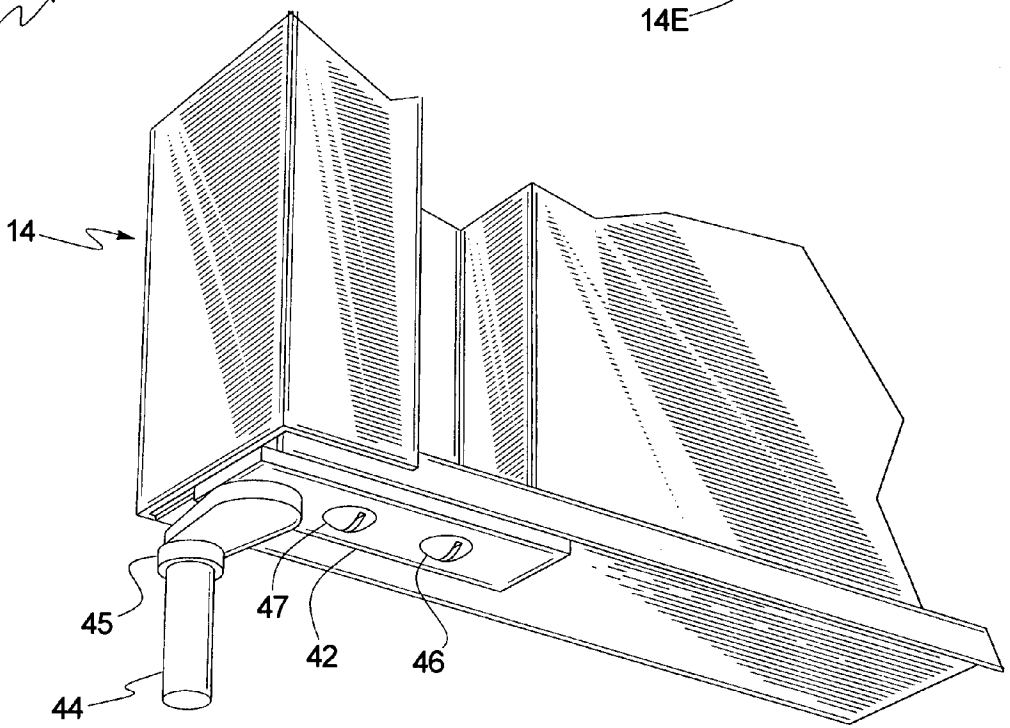
FIG. 6B is a fragmentary perspective view of the bottom of the right side door panel of FIG. 6A with the bottom pivot pin plate attached together with a bushing.

As shown in FIG. 6A, as viewed from the bottom, the door panel 14 of FIG. 6B is constructed of reinforcing channels 14A, 14B mounted on a backside of a front surface 14E of the door panel 14. Side walls 14D and 14H are also provided.

The bottom and top of the door 14 have respective end surfaces 14C, 14J. Each of these end surfaces has respective mounting apertures 14F, 14G and 14K, 14I for receiving the respective screws for attaching the pivot pin mounting plates 42 and 56 previously described.

The bottom and top pivot pins 44 and 200 have their longitudinal center line aligned in a plane of the front surface 14E of the door panel 14. Thus half of each pin sticks out beyond the front of the door so that the door 14 (and similarly door 15) can be opened by 180° when cabinets are side-by-side.

The construction of left door 15 is similar to right door 14 described above and therefore has not been separately described.

Figure 7B:
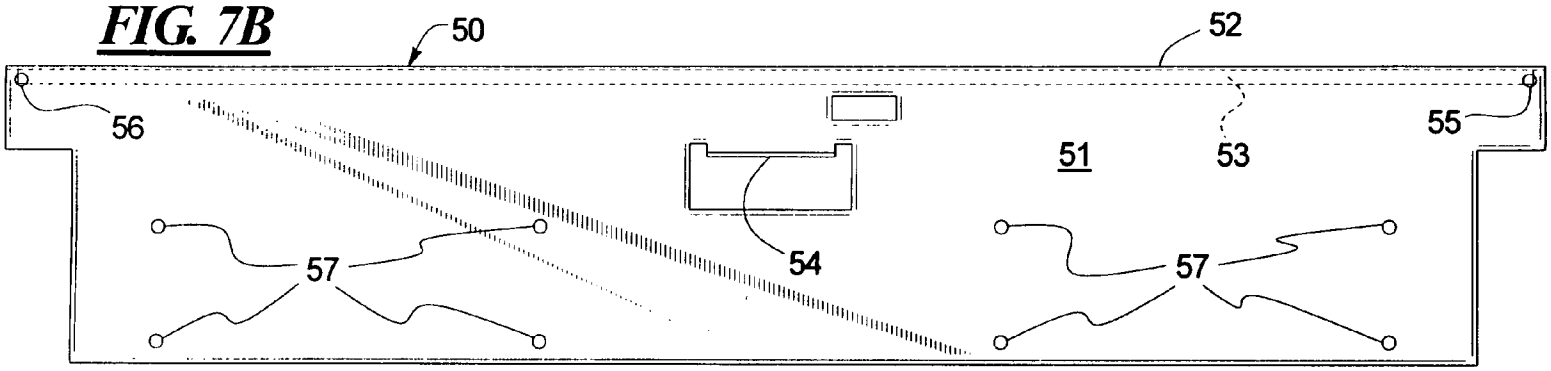
FIG. 7B is a plan view of the cabinet top door jamb.
Figure 7C:
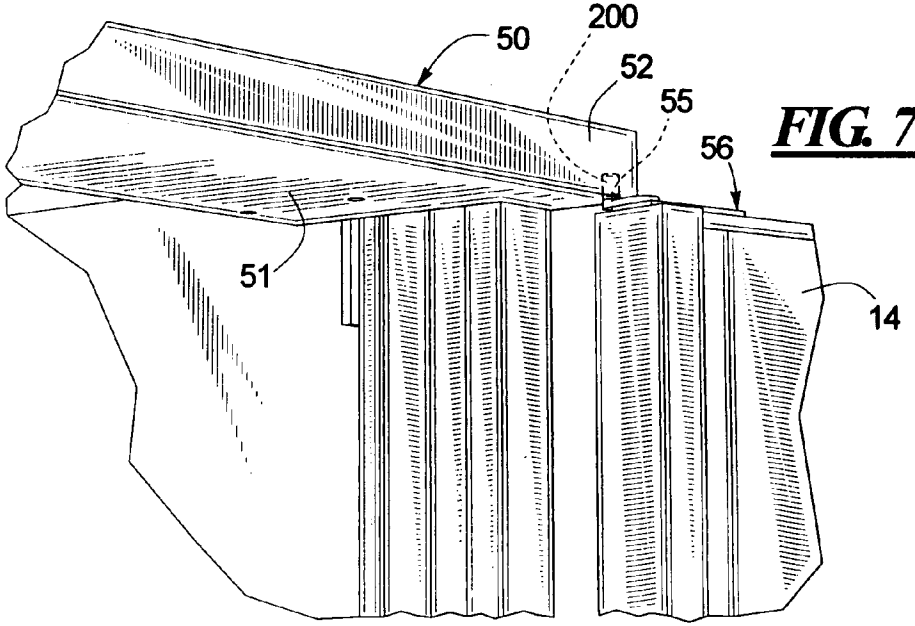
FIG. 7C is a fragmentary perspective view showing the top door jamb installed together with the right side door panel.
Figure 7A:
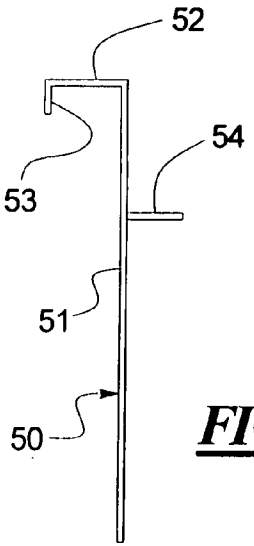
FIG. 7A is an end view of the cabinet top doorjamb.

FIGS. 7A and 7B are respective end and plan views of the top door jamb 50. Top door jamb 50 has a lower horizontal surface 51 with a projection 54 serving as a stop for door panels 14 and 15. The horizontal lower surface 51 also has a plurality of mounting holes 57.

A front jamb surface 52 is positioned at the front edge of lower surface 51 which bends over into a top lip 53.

Door panel pivot holes 55 and 56 receive respective pivot pins on the door panels.

As shown in the fragmentary perspective view of FIG. 7C, the top door jamb 50 is placed on the top pivot pins of the respective door panels and then the top door jamb 50 is mounted in place to the top shelf support previously described.

With the door system and method described in the preferred embodiment, there is a modern appearance with no frame or hinges on the sides. Elimination of the frame provides a greater height opening for storage access. Also, file access to the top shelf is not obstructed.

A welding fixture is not needed, making manufacture of more sizes feasible.

The bottom jamb replaces a traditional base for anchoring.

A smaller shipping package is possible to help reduce shipping damage.

The optional extension unit is available to provide clearance for the front of the files which extend beyond the shelves.

By eliminating the welded frame, there is the advantage of manufacturing simplicity. To the contrary, when welding a frame, it is difficult to keep the frame square and true, and thus difficult to maintain accuracy.

Many of the parts of the door system described can be sheared and punched with simplicity.

When mounting the various components, bolting in the field results in no distortions to the overall system. Moreover, a minimal number of relatively smaller parts are shipped and damage can be prevented.

The assembly method for the door system is simple and straight forward, and generally follows the previously described drawing Figures. Of course, changes in the sequence of assembly steps is also possible.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim:

1. A door panel system for attachment to a metal shelving cabinet, said metal shelving cabinet having at least two front corner posts, shelf supports connected to the corner posts supporting shelves, and at least a top surface and two side surfaces, comprising:

a bottom support attached between a bottom of the two front corner posts;

a top support attached between a top of the two corner posts;

a bottom door jamb separate from and attached to the bottom support;

a top doorjamb separate from and attached to the top support;

the upper and lower door jambs having respective receiving holes for pivot pins; and right and left door panels each having pivot pins received in the pivot pin apertures of the upper and lower door jambs.

2. The system according to claim 1 wherein an extender is provided between each of the front corner posts and the respective right and left door panels.

3. The system according to claim 2 wherein the extender has a back surface which is attached to a flange of each front corner post.

4. The system according to claim 3 wherein the extender further comprises an extender clamp comprising first and second clamping side surfaces and a junction surface therebetween and clamps to the back surface to the flange.

5. The system according to claim 4 wherein the extender clamp has on one of its clamping side surfaces a set screw.

6. The system according to claim 2 wherein the extender comprises an inside lip, a front surface, an outer side surface, and a back attachment surface.

7. The system according to claim 1 wherein a bushing is received over each of the bottom pivot pins.

8. The system according to claim 1 wherein the pivot pins are on a pivot plate which is attached by screws at the top and bottom of each of the right and left door panels.

9. The system according to claim 1 wherein the bottom door jamb has a horizontal upper surface stepped up from a horizontal lower surface with the horizontal lower surface being toward a front of the cabinet, and wherein an extension of the horizontal lower surface has said pivot pin apertures for receiving said pivot pins of the door panels.

10. The system according to claim 1 wherein a step surface is provided between lower and upper surfaces of the bottom jamb, the step surface being an abutment jamb surface against which the door panels close.

11. The system according to claim 1 wherein the top door jamb has a lower horizontal surface with a projection serving as a stop jamb for the door panels, a front external surface being positioned at a front edge of the lower surface.

12. The system according to claim 11 wherein a top lip is provided at a top of the front external surface.

13. The system according to claim 1 wherein the bottom door jamb is connected by screws to the bottom support.

14. The system according to claim 1 wherein the top jamb is connected by screws to the top support.

15. The system according to claim 1 wherein a bottom shelf overlays a horizontal raised surface of the bottom jamb.

16. The system according to claim 1 wherein each of the door panels has a front surface and first and second channels at a backside thereof.

17. The system according to claim 1 wherein each of the door panels has upper and lower edge surfaces and side surfaces.

18. The system according to claim 1 wherein each of the shelf supports has locking pins at ends thereof received in locking apertures in the respective corner posts.

19. The system of claim 1 wherein the top and bottom supports are the same as the shelf supports.

20. A door panel system for attachment to a metal cabinet, said metal cabinet having at least two L-shaped front corner posts, and at least a top surface and two side surfaces, comprising:

a bottom support attached between a bottom of the two front corner posts;

a top support attached between a top of the two corner posts;

a bottom doorjamb separate from and attached to the bottom support;

a top door jamb separate from and attached to the top support;

the upper and lower door jambs having respective receiving holes for pivot pins; and right and left door panels each having pivot pins received in the pivot pin apertures of the upper and lower door jambs.

21. The system of claim 20 including bushings received over each of the bottom pivot pins.

* * * * *